United States Patent [19]

Facey

[11] Patent Number: 4,520,951

[45] Date of Patent: Jun. 4, 1985

[54] AEROSOL CAP

[75] Inventor: Roy B. Facey, Pymble, Australia

[73] Assignee: CRC Chemicals Inc., Warminster, Pa.

[21] Appl. No.: 154,750

[22] Filed: May 30, 1980

[51] Int. Cl.[3] ..... B65D 83/14

[52] U.S. Cl. ..... 222/182; 222/538

[58] Field of Search ..... 222/182, 192, 402.13, 222/538; 215/100 R; 220/855 P

[56] References Cited

U.S. PATENT DOCUMENTS

| | | | |
|---|---|---|---|
| 1,411,573 | 4/1922 | McGarrahan | 222/538 |
| 3,221,950 | 12/1965 | O'Donnell | 222/402.13 X |
| 3,276,641 | 10/1966 | Lehmann | 222/538 X |
| 3,428,220 | 2/1969 | Osrow | 222/182 X |
| 3,732,591 | 5/1973 | Gach | 222/192 X |

FOREIGN PATENT DOCUMENTS

| | | | |
|---|---|---|---|
| 893535 | 2/1972 | Canada | 190/1 |
| 952070 | 7/1974 | Canada | 271/45 |
| 1154775 | 6/1969 | United Kingdom | 222/182 |

*Primary Examiner*—F. J. Bartuska

*Attorney, Agent, or Firm*—Panitch Schwarze Jacobs & Nadel

[57] ABSTRACT

A cap for an aerosol container has a transverse groove in its top for retaining therein a dispensing tube.

5 Claims, 3 Drawing Figures

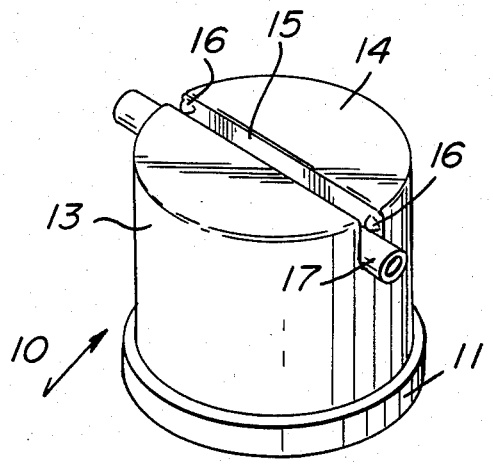
FIG. 1
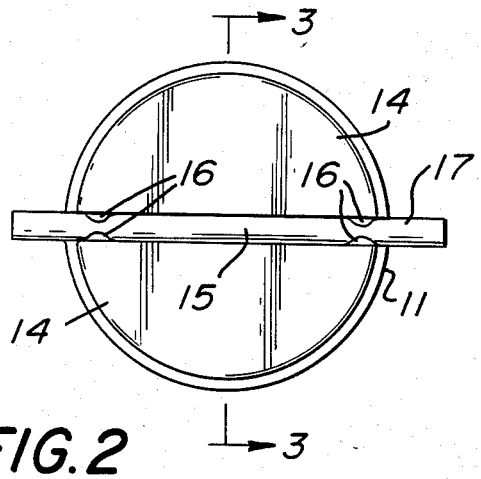
FIG. 2
FIG. 3
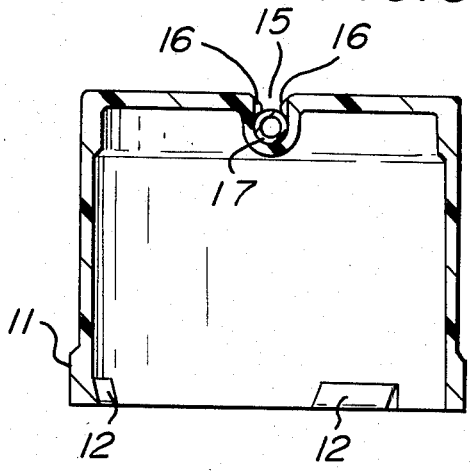

AEROSOL CAP

BACKGROUND

This invention relates to an aerosol cap and has been devised particularly though not solely for use with aerosols which require a dispensing tube to be fitted to the valve of the aerosol container.

In the past, aerosol products have commonly been packed in disposable pressurized cans having an aerosol valve in one end of the can.

To assist with the application of some products which require to be placed in difficult situations with some degree of accuracy, it has been known to provide a small bore tube commonly of flexible plastics material which may have one end inserted into the outlet of the aerosol valve so that the aerosol product may be applied through the tube. Such tubes have been fastened to the aerosol can for sale by way of adhesive tape which has the disadvantages that it is slow to package and therefore uneconomical and furthermore does not provide a convenient way of retaining the tube with the aerosol can once the tube has been used for a first time. To overcome this disadvantage, it has been known to provide retaining means molded into the upright side of a cap for an aerosol container so that the tube may be held in the retaining means when not in use. Such caps have been of a diameter substantially the same as the diameter of the aerosol can so that the tube may be fixed in an upright position on the outer periphery of the cap and extend down the side of the can when packed.

This arrangement has the disadvantage that a comparatively large cap must be provided of the same diameter as the diameter of the can, which is uneconomical to manufacture due to the comparatively large amount of plastics material which must be used in the manufacture of the cap. Smaller caps which engage with the upstanding flange surrounding the aerosol cap have been used to reduce the amount of plastics material required but such caps have not been suitable for the mounting of a dispensing tube.

SUMMARY OF THE INVENTION

The invention may broadly be said to consist in a cap for a can adapted to hold aerosol products and having an aerosol valve at one end thereof surrounded by an upstanding flange. The cap has a lower rim adapted to engage said flange, a continuous peripheral sidewall, a closed upper end or top, and retaining means arranged to hold an aerosol dispensing tube laterally across the top of said cap.

Preferably, said cap is formed by molding from a suitable plastics material. Preferably, said retaining means comprise a transverse groove in the upper end of said cap incorporating one or more inwardly extending protuberances at the mouth of said groove. Alternatively, said retaining means comprise a plurality of lugs protruding from the top of said cap and arranged to engage said tube.

It is therefore an object of the present invention to provide an aerosol cap which will obviate or minimize the foregoing disadvantages of the prior art in a simple yet effective manner or which will at least provide the public with a useful choice.

For the purpose of illustrating the invention, there is shown in the drawings a form which is presently preferred; it being understood, however, that this invention is not limited to the precise arrangements and instrumentalities shown.

FIG. 1 is a perspective view of an aerosol cap according to the invention.

FIG. 2 is a plan view of the top of the aerosol cap shown in FIG. 1.

FIG. 3 is a cross-sectional elevation along the line 3—3 of FIG. 2.

DETAILED DESCRIPTION

In the preferred form of the invention a cap 10 for a pressurized can adapted to hold aerosol products is constructed as follows:

The cap 10 is formed by molding from a suitable plastics material so as to incorporate a lower rim 11 which is adapted to engage the upstanding flange surrounding the aerosol valve on the top of a can. To this end, the rim 11 is formed to a slightly larger diameter than the outside diameter of the upstanding flange and is provided with engagement means which may for example comprise inwardly extending lugs 12. The engagement means may of course take other forms such as a plurality of inwardly extending diamond-shaped protrusions around the inner periphery of the lower rim of the cap.

The cap 10 is molded to include a peripheral sidewall which is preferably cylindrical in configuration but which may alternatively be formed from a number of short sides to the configuration of a polygon.

A closed upper end 14 is provided across the top of the cap 10 and retaining means in the form of a transverse groove or slot 15 is provided molded into the top of the cap 10. The groove 15 is provided with one or more inwardly protruding dimples 16 and in the preferred form of the invention four such dimples 16 are provided, there being two oppositely orientated dimples 16 adjacent each end of the groove 15.

The width of the transverse groove 15 and the spacing between the adjacent pairs of dimples 16 is such that a resilient plastics tube 17 used for dispensing the aerosol product in the can will lie within the transvere slot 15 and be retained by the dimples 16. In this manner, the aerosol dispensing tube 17 is held laterally across the top of the cap.

Although one preferred form of retaining the tube 17 laterally across the top of the cap 10 has been described, it will be apparent that the tube 17 could be so held laterally in a number of ways all of which are preferably molded integrally with the top of the cap 10. For example, two U-shaped lugs could be molded at opposite ends of a diameter of the cap 10 so that the tube 17 can clip into the lugs and so be retained across the top of the cap 10. In a similar manner, two upstanding ridges could be provided across a diameter of the top of the cap 10 spaced apart sufficiently so as to form a groove between the ridges to hold the tube 17 in a similar manner to the groove or slot 15.

Numerous other configurations of holding the tube 17 across the top of the cap 10 in a lateral manner are also possible and would fall within the scope of this invention.

In this manner, an aerosol cap 10 is provided which because it is small in diameter and adapted to fit onto the upstanding flange surrounding the aerosol valve on the pressurized can, uses a minimum quantity of plastics material and is therefore economical to manufacture. At the same time, provision has been made for retaining an aerosol dispensing tube 17 in the cap 10 so that the tube 17 may be retained with the aerosol can throughout the life of the can and yet be instantly available for use when required.

The present invention may be embodied in other specific forms without departing from the spirit or essential attributes thereof and, accordingly, reference should be made to the appended claims, rather than to the foregoing specification, as indicating the scope of the invention.

I claim:

1. A cap for an aerosol container comprising an annular wall open at its bottom end and closed at its upper end by a top wall, the top wall having a transverse groove releasably retaining a tube in a lower most portion thereof, said groove being open at each end, said tube being longer than the length of said groove, the groove having inwardly directed protuberances adjacent the uppermost portion thereof at spaced locations along the uppermost portion for relesably retaining the tube in said groove, and means adjacent to inner periphery of the bottom end for engaging and securing the cap to the top end of an aerosol container.

2. A cap in accordance with claim 1 wherein said second-mentioned means includes a plurality of radially inwardly directed lugs on the inner periphery of said bottom end.

3. A cap in accordance with claim 1 wherein said groove has two sets of protuberances, each set of protuberances being adjacent one end of the groove.

4. A cap for an aerosol container comprising an annular wall open at it bottom end and closed at it upper end by a top wall perpendicular to the annular wall, the top wall having a diametric transverse groove formed integral with the top wall and adapted to releasably retain a tube in a lowermost portion thereof, said groove being open at each end, the groove having a substantially semi-circular cross-section at the lowermost half thereof and having substantially parallel straight sides at the uppermost half thereof integral with the top wall so as to be open at the top, the groove further having protuberances along the inner faces of the parallel sides adjacent the upper most portion of the sides at spaced locations along the inner faces thereof for frictionally embracing and releasably retaining the tube in the groove, and a plurality radially directed lugs at spaced portions along the inner periphery of the annular wall at the lowermost portion thereof for engaging and releasably securing the cap to the top end of the container.

5. A cap in accordance with claim 4 wherein the tube is longer than the diameter of the annular wall.

* * * * *

UNITED STATES PATENT AND TRADEMARK OFFICE

CERTIFICATE OF CORRECTION

PATENT NO. : 4,520,951

DATED : June 4, 1985

INVENTOR(S) : Roy B. Facey

It is certified that error appears in the above-identified patent and that said Letters Patent is hereby corrected as shown below:

On the cover of the above-identified patent, item (30) should be added to read: --Foreign Application Priority Data August 31, 1979 Australia .... PE0287--.

Signed and Sealed this

*Fifteenth* Day of *October 1985*

[SEAL]

*Attest:*

DONALD J. QUIGG

*Attesting Officer*

*Commissioner of Patents and Trademarks—Designate*